United States Patent [19]

Mazzorana

[11] 4,175,237

[45] Nov. 20, 1979

[54] ELECTRIC STARTER FOR AN ENGINE

[76] Inventor: Alfred B. Mazzorana, 12, rue Fernand Léger, 69200 Venissieux, France

[21] Appl. No.: 806,249

[22] Filed: Jun. 13, 1977

[30] Foreign Application Priority Data

Jun. 22, 1976 [FR] France ..... 76 19543

[51] Int. Cl.[2] ..... F02N 11/00

[52] U.S. Cl. ..... 290/38 R; 74/7 A

[58] Field of Search ..... 74/6, 7 R, 7 A; 290/38; 310/90

[56] References Cited

U.S. PATENT DOCUMENTS

| | | | |
|---|---|---|---|
| 2,455,328 | 11/1948 | Buxton | 74/7 A |
| 2,850,906 | 9/1958 | Mendenhall | 74/7 |
| 2,976,438 | 3/1961 | Luber | 310/90 |
| 3,087,078 | 4/1963 | Brown | 310/90 |
| 3,223,863 | 12/1965 | Preece et al. | 290/38 R |
| 3,818,768 | 6/1974 | Hardy | 74/6 |

*Primary Examiner*—Robert K. Schaefer
*Assistant Examiner*—John W. Redman
*Attorney, Agent, or Firm*—Dowell & Dowell

[57] ABSTRACT

An electric starter for internal combustion engines has a drive pinion unit with gear teeth for engagement with a gear ring of the engine and is driven by an electric motor so as to rotate the engine. The motor has a rotating laminated armature and an armature shaft; the drive pinion unit is mounted on the shaft so as to be freely slidable and rotatable relative thereto, and splined drive means fixed to one end of the laminated armature engage splines on the drive pinion unit whereby to transmit drive to the latter. The drive means may take the form of an internally-splined sleeve co-operating with a tail portion of the drive pinion unit; the splines are preferably helicoidal.

6 Claims, 2 Drawing Figures

ELECTRIC STARTER FOR AN ENGINE

BACKGROUND OF THE INVENTION

1. Field of the Invention

The present invention relates to electric starters intended for starting internal combustion engines, and it concerns more particularly the rotational driving of the drive pinion unit.

2. Description of the Prior Art

In conventional starters the armature of the electric motor is fastened against angular movement on a shaft, which in turn is provided with generally helicoidal splines permitting the rotational driving of the drive pinion unit. The shaft therefore takes the entire driving torque, so that it must be made with particular care. It is first of all necessary to select a high-strength steel capable of being treated before its main parts are ground. In addition, in the production of the shaft care must be taken to avoid the risk of fracture at the point where changes of diameter occur. Finally, the driver of the drive pinion unit is completely machined so that its cost is high.

SUMMARY OF THE INVENTION

The present invention seeks to simplify the production of armature shafts of electric starters and reproduction of the corresponding driver with a view to obtaining a starter which matches the quality of known units, but which is less expensive to make. Accordingly, means are provided for the direct driving of the drive pinion unit from the stack of laminations of the armature of the starter motor, the drive pinion unit being freely slidable and rotatable on the armature shaft.

DESCRIPTION OF THE PREFERRED EMBODIMENTS

Figure 1:
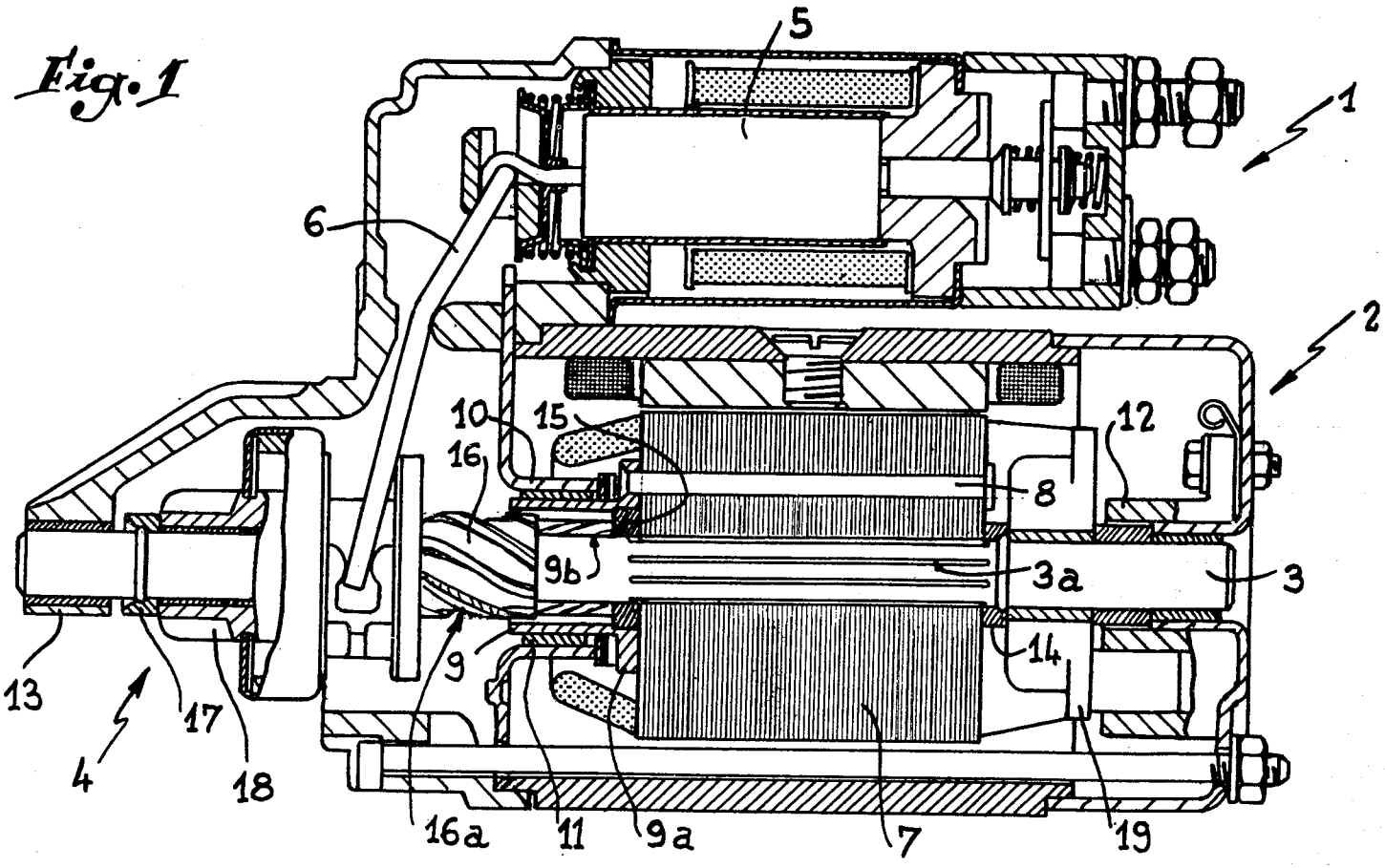
FIG. 1 is a longitudinal section of an electric starter incorporating the invention and shown in the operating state.

The starter shown in FIG. 1 comprises in the usual way a switch 1 and an electric motor 2 on whose shaft 3 is mounted a drive pinion unit 4 adapted to move longitudinally on the shaft, which motor also drives it rotationally. Between the core or movable element 5 of the switch 1 and the drive pinion unit 4 is provided a rocking lever 6 of the kind described in the Applicants' prior French Specification No. 75,34934 and also in the first certificate of addition thereto, French Specification No. 76.12842, both incorporated herein by reference.

The stack of magnetic laminations 7 is fastened against angular movement on the shaft 3 by means of the usual longitudinal projections 3*a* formed on the periphery of the shaft and has passing through it a number of rivets 8 securing the stack to a tubular sleeve 9 with the aid of a collar 9*a* on the latter.

The periphery of the sleeve 9 is cylindrical and it is mounted for rotation in a fixed bearing 10 fastened to the frame of the motor 2. In the case illustrated an anti-friction ring 11 is provided between the sleeve 9 and the bearing 10.

It will be noted that the shaft 3 also turns in a second bearing 12 in the frame of the motor and in a third bearing 13 provided in the "nose" of the starter. It will also be observed that the shaft 3 is held longitudinally in relation to the stack of laminations 7 by means of a stop ring 14 suitably fastened to the said shaft, for example with the aid of a circlip or other securing ring, while another stop ring 15, captive between the stack of laminations 7 and a shoulder formed in the sleeve 9, centres the latter in relation to the shaft 3.

The bore of the sleeve 9 is provided with helicoidal splines 9*b* adapted to cooperate with male helicoidal teeth 16*a* cut in tail 16 of the drive pinion unit 4, which has a bore (not shown) enabling it to slide freely along the shaft 3 between the ring 15 and a stop 17 provided on the shaft 3 in the immediate proximity of the bearing 13. When the starter is driving the large annular gearwheel on the flywheel of the engine, the pinion 18 of the drive pinion unit bears against the said stop 17 through the cooperative action of the helicoidal splines 9*b* and the teeth 16*a*.

It will be appreciated that the arrangement described above helps reduce or eliminate torsional stressing of the shaft 3, the latter acting only as a support for the stack of laminations 7 and for the drive pinion unit 4. It can therefore be made of a steel not requiring heat treatment, while in addition it is of constant diameter, thereby eliminating the risk of fracture which occurs with conventional starter shafts at changes of diameter, which are required in known constructions because the shafts of the latter are provided with male helicoidal teeth adapted to cooperate with corresponding female teeth provided in the drive pinion unit 4.

The pinion tail 16 or driver is made by cold extrusion, so that its bore is left rough, thus achieving a substantial saving in comparison with the production of the usual drivers.

Figure 2:
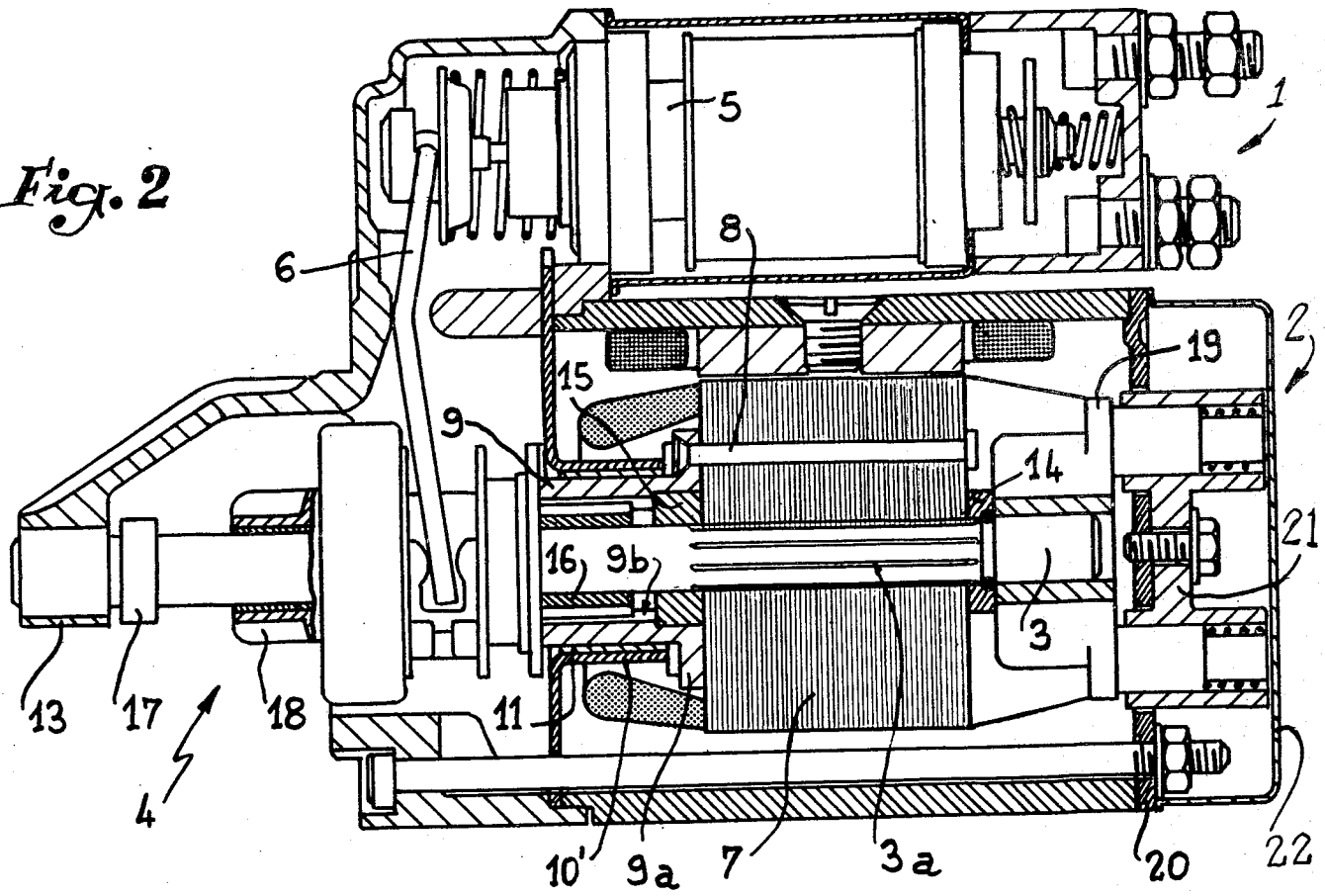
FIG. 2 shows a modified embodiment in which the drive pinion unit is at rest.

As shown in FIG. 2, the construction of the starter described above can be further simplified by eliminating the bearing 12. For this purpose the bearing 10' is reinforced and given a larger diameter and greater length, compared with bearing 10 of FIG. 1. In the construction of FIG. 2 the shaft 3 is mounted for rotation only in the two bearings 10' and 13, while its portion supporting the stack of laminations 7 and the commutator 19 is cantilevered. This portion can therefore be limited so that its end is situated at the commutator. The frame of the starter is then closed in this region by means of a simple flat plate 20 intended to carry a brush carrier unit 21 placed on the outside and protected by a cover 22, as described in the previously mentioned prior French Specification No. 75,34934 of the present Applicants.

An electric starter in which the drive pinion unit is driven is thus produced in a simple, economical manner with a view to considerably increasing the general strength of the apparatus.

It must in addition be understood that the above description has been given only by way of example and that it does not in any way restrict the scope of the invention, which would not be exceeded by replacing the constructional details described by any other equivalent. In particular it is obvious that the splines 9*b* could be straight, the helicoidal profile mentioned above constituting only a particularly advantageous embodiment.

What is claimed is:

1. In an electric starter for an internal combustion engine having an electric motor with a rotating laminated armature on an armature shaft, and having a drive pinion mounted on the shaft with gear teeth on the pinion for engagement with a gear ring of the engine for rotation of the engine when driven by the motor, the improvement comprising a portion of said drive pinion extending toward said armature, the drive pinion and said portion being freely slidable and rotatable relative to the shaft and said portion having an annular splined surface, a drive sleeve fixed to one end of the laminated armature and having an annular splined surface surrounding the shaft in spaced relation thereto and arranged for interengagement with said splined drive pinion portion for direct rotational driving of the pinion from the laminated armature.

2. In an electric starter for an internal combustion engine having an electric motor with a rotating laminated armature on an armature shaft, and having mounted on the shaft a drive pinion having a nose portion with gear teeth for engagement with a gear ring of said engine for rotation of said engine when driven by the motor and having an externally splined tail portion, the improvement wherein said pinion is mounted on the shaft with the tail portion toward said armature, the pinion being freely slidable and rotatable relative to the shaft, and the improvement further comprising a drive sleeve fixed to one end of the laminated armature and having an internal surface spaced from the shaft and splined for interengagement with said externally splined tail portion of the drive pinion for direct rotational driving of the unit from the laminated armature.

3. A starter as defined in claim 2, further including restraining means intermediate the laminated armature and the armature shaft, whereby to restrain the armature from rotation relative to the shaft when the drive pinion is driven rotationally.

4. A starter as defined in claim 2, wherein the splines are helicoidal.

5. A starter as defined in claim 2, wherein the starter comprises a frame, a first bearing mounted in the frame and rotationally supporting the sleeve, and a second bearing also mounted in the frame and rotationally supporting an end of the armature shaft remote from the drive pinion.

6. A starter as defined in claim 2, wherein the starter comprises a frame, and a bearing mounted in the frame and rotationally supporting the sleeve, whereby to support in cantilever fashion an end of the armature shaft remote from the drive pinion unit.

* * * * *